US005577498A

United States Patent [19]

Yoshida et al.

[11] Patent Number: 5,577,498

[45] Date of Patent: Nov. 26, 1996

[54] SEMI-CLOSED TYPE BREATHING APPARATUS FOR REMOVING CARBON DIOXIDE FROM BREATHING AIR CIRCUIT HAVING TRIANGULARLY SHAPED BELLOWS

[75] Inventors: Akihiko Yoshida; Yasushi Yoshida; Junichi Shiobara, all of Saitama-ken; Kyoichi Fujimori, Higashimatsuyama; Hitoshi Sugimoto, Higashimatsuyama; Akihiko Yatsunami, Higashimatsuyama; Yoshihisa Fujisawa, Saitama-ken, all of Japan

[73] Assignee: Zexel Corporation, Tokyo, Japan

[21] Appl. No.: 267,589

[22] Filed: Jun. 29, 1994

[30] Foreign Application Priority Data

| | | | |
|---|---|---|---|
| Jul. 7, 1993 | [JP] | Japan | 5-192859 |
| Jul. 7, 1993 | [JP] | Japan | 5-192860 |
| Jul. 7, 1993 | [JP] | Japan | 5-192862 |
| Jul. 7, 1993 | [JP] | Japan | 5-192863 |
| Oct. 7, 1993 | [JP] | Japan | 5-059494 U |

[51] Int. Cl.[6] ..... A62B 7/10; A62B 23/02; A62B 18/10; B63C 11/02

[52] U.S. Cl. ..... 128/205.28; 128/205.12; 128/205.22; 128/201.27; 128/201.28; 128/205.24; 128/204.26; 128/205.13

[58] Field of Search ..... 128/200.29, 201.13, 128/201.25–201.28, 204.26, 204.28, 205.13–205.17, 205.22, 205.28, 201.22–201.24, 202.14, 202.26, 202.27, 204.18, 205.12, 205.24

[56] References Cited

U.S. PATENT DOCUMENTS

| | | | |
|---|---|---|---|
| 2,348,074 | 5/1944 | Lambertsen | 128/205.28 |
| 2,403,981 | 7/1946 | Jackson et al. | 128/202.26 |
| 2,485,908 | 10/1949 | Morrow | 128/200.29 |
| 2,486,427 | 11/1949 | Miller et al. | 128/201.28 |
| 2,902,031 | 9/1959 | Gagnan | 128/204.26 |
| 3,085,571 | 4/1963 | Novelli et al. | 128/204.28 |
| 3,468,307 | 9/1969 | Cummins | 128/204.26 |
| 3,568,672 | 3/1971 | Cupp | 128/200.29 |
| 3,967,459 | 7/1976 | Denis | 128/202.14 |
| 3,968,795 | 7/1976 | O'Neill et al. | 128/201.27 |
| 4,231,361 | 11/1980 | Wise | 128/202.26 |
| 4,781,184 | 11/1988 | Fife | 128/205.24 |
| 4,793,340 | 12/1988 | Ottestad | 128/200.29 |
| 5,052,384 | 10/1991 | Kaneko | 128/205.17 |
| 5,195,516 | 3/1993 | Grimsey | 128/204.26 |
| 5,271,390 | 12/1993 | Gray et al. | 128/202.27 |
| 5,299,567 | 4/1994 | Joye et al. | 128/204.28 |

FOREIGN PATENT DOCUMENTS

| | | |
|---|---|---|
| 5038397 | 4/1975 | Japan . |

*Primary Examiner*—Kimberly L. Asher

*Attorney, Agent, or Firm*—Sughrue, Mion, Zinn, Macpeak & Seas

[57] ABSTRACT

A semi-closed type of breathing apparatus includes an air exhaling duct for guiding breathing air exhaled from a mouthpiece to a canister filled with a carbon dioxide remover, and an air inhaling duct for guiding the breathing air, from which carbon dioxide has been removed, to the mouthpiece. The air inhaling duct and the air exhaling duct are designed in a double-duct structure such that the air inhaling duct is surrounded by the air exhaling duct. That is, the ducts are formed in a single hose. Therefore, detachment of the breathing apparatus from a user is easily performed, the overall appearance of the apparatus is not marred, and the entire construction of the apparatus is simplified.

13 Claims, 12 Drawing Sheets

SEMI-CLOSED TYPE BREATHING APPARATUS FOR REMOVING CARBON DIOXIDE FROM BREATHING AIR CIRCUIT HAVING TRIANGULARLY SHAPED BELLOWS

BACKGROUND OF THE INVENTION

1. Field of the Invention

This invention relates to a breathing apparatus which is used in water and on land, and particularly to a semi-closed type of breathing apparatus in which carbon dioxide is removed from breathing air circulating in a breathing circuit to use the breathing air, and the breathing air is supplemented into the breathing circuit from a air tank.

2. Description of Related Art

In general, the semi-closed type of breathing apparatus is equipped with a mouthpiece, a carbon dioxide absorber (canister) for absorbing carbon dioxide, a breathing bag and a pressure air tank. In the semi-closed type of breathing apparatus thus constructed, carbon dioxide is removed from the breathing air in the breathing circuit by the canister, and fresh air is supplied from the air tank into the breathing circuit while surplus breathing air is discharged from the breathing circuit.

A conventional semi-closed type of breathing apparatus is disclosed in Japanese Laid-open Patent Application No. 50-38397. The mouthpiece of the breathing apparatus as disclosed in this publication has two ducts connected to each other, that is, an air inhaling duct and an air exhaling duct which serve to circulate the air through the canister and are disposed separately from each other.

However, when the semi-closed type of breathing apparatus having the mouthpiece thus constructed is used, the two ducts of the air inhaling and exhaling ducts are arranged to extend from the face of an user to the right and left sides thereof, so that the user cannot smoothly carry the breathing apparatus on his back and detach it from his back. In addition, this construction mars the overall appearance of the breathing apparatus.

In view of the foregoing, one possible solution would be to bundle the two ducts. However, simply bundling of the ducts still mars the overall appearance of the breathing apparatus and does not meet the requirement of simplifying the entire construction of the apparatus.

SUMMARY OF THE INVENTION

A first object of the present invention is to provide a semi-closed type of breathing apparatus which enables simplification of the entire construction of the apparatus, and to provide a semi-closed type of breathing apparatus in which the carrying and detaching of the breathing apparatus on and from user's back can be carried out easily and smoothly, and the overall appearance of the apparatus is not marred.

A second object of the present invention is to provide a semi-closed type of breathing apparatus in which a canister is designed to be of a cartridge type which has a carbon dioxide absorber (remover) therein and is loadable into the breathing apparatus to simplify the whole construction of the apparatus, and forgetting to load the cartridge is prevented.

A third object of the present invention is to provide a breathing apparatus for diving which can be simplified in construction and easily fabricated.

A fourth object of the present invention is to provide a semi-closed type of breathing apparatus which can be simplified in construction, and in which an air exhaling sound of surplus breathing air in a breathing circuit can be suppressed.

A fifth object of the present invention is to provide a breathing apparatus for diving which can be simplified in construction, and in which a breathing operation can be smoothly performed.

In order to attain the first object, a semi-closed type of breathing apparatus for removing carbon dioxide from breathing air in a breathing circuit comprises a mouthpiece which an user takes in his mouth to perform exhalation and inhalation, a canister which is filled with carbon dioxide remover to remove carbon dioxide from breathing air, a breathing bag which is connected to the mouthpiece and the canister and expands and contracts in accordance with the flow in-and-out of breathing air, a duct designed in a double-duct structure which serves to connect the mouthpiece to the canister and the breathing bag, and comprises an inner duct for air inhalation and an outer duct for air exhalation which is disposed so as to surround the inner duct and connected to the breathing bag, and an air tank for introducing fresh breathing air into the breathing circuit.

According to the first aspect of this invention, the air inhaling duct which is connected to the mouthpiece, is disposed inside of the air exhaling duct, that is, the air inhaling and exhaling ducts are designed in a double-duct structure, and thus these ducts appear from the exterior as a single hose. Therefore, the detachment of the breathing apparatus from the user's back can be easily performed, the overall appearance of the apparatus is not marred, and the entire construction of the apparatus can be simplified.

In order to attain the second object, a semi-closed type of breathing apparatus for removing carbon dioxide from breathing air in a breathing circuit comprises a mouthpiece which an user takes in his mouth to perform exhalation and inhalation, a canister which is filled with carbon dioxide remover to remove carbon dioxide the breathing air, the canister comprising a case, and a load equipment into which a cartridge having carbon dioxide remover therein is loaded, wherein the load equipment includes a closing member for closing an outlet passage of the canister when no cartridge is loaded, urging means for urging the closing member to close the outlet passage, and moving means for moving the closing member against the urging means when the cartridge is loaded, thereby opening the outlet passage, a breathing bag which is connected to the mouthpiece and the canister and expands and contracts in accordance with the flow in-and-out of breathing air, a duct through which the mouthpiece is connected to the canister and the breathing bag, and an air tank for supplementing fresh air into the breathing circuit.

According to the second aspect of this invention, the canister is designed as a cartridge type, so that the whole construction of the apparatus can be simplified. Further, when no canister cartridge is loaded, the open-and-close member is urged by the urging means to close the passage of the circuit, so that the user is prevented from breathing. Accordingly, even when the user forgets to load the canister cartridge, he cannot breathe in the mouthpiece, so that the user can be immediately aware that no canister cartridge is loaded. Therefore, the nonloading of the canister cartridge can be prevented.

In order to attain the third object, a semi-closed type of breathing apparatus for removing carbon dioxide from breathing air in a breathing circuit comprises a mouthpiece which an user takes in his mouth to perform exhalation and inhalation, a canister which is filled with carbon dioxide remover to remove carbon dioxide from the breathing air, a breathing bag which is connected to the mouthpiece and the canister and expands and contracts in accordance with the flow in-and-out of breathing air, a duct which serves to connect the mouthpiece to the canister and the breathing bag, an air tank for supplementing fresh air into the breathing circuit, and a demand mechanism which is provided to the mouthpiece and with which intermediate-pressure air whose pressure is higher than the inner pressure of the breathing circuit is purged from the air tank into the mouthpiece if occasion demands, wherein the demand mechanism comprises a connection nipple to which an intermediate-pressure hose is connected, and a valve plug which serves to open and close the connection nipple and is provided with an intercommunication hole which is intercommunicated with the valve chest and serves to supply low-pressure air, and wherein when a purging operation is carried out while the low-pressure air is supplied through the intercommunication hole into the breathing circuit at all times in a state where the valve plug is closed, the valve plug is opened to introduce the intermediate-pressure air into the breathing circuit.

According to the third aspect of this invention, the intermediate-pressure air is supplied from the intermediate-pressure air hose into the connection nipple, passed through the intercommunication hole of the valve plug and dispersed into the breathing circuit 8, so that the pressure of the intermediate-pressure air is reduced. Therefore, the low-pressure breathing air is supplied into the breathing circuit at all times.

On the other hand, when the air is purged into the breathing circuit, the valve plug is opened to directly introduce the intermediate-pressure air from the connection nipple into the breathing circuit if occasion demands.

Accordingly, two kinds of pressurized air, that is, the intermediate-pressure air and the low-pressure air can be supplied with only one intermediate-pressure hose, so that the construction of the demand function can be facilitated, and the fabrication of the apparatus can be simplified.

In order to attain the fourth object of this invention, a semi-closed type of breathing apparatus for removing carbon dioxide from breathing air in a breathing circuit comprises a mouthpiece which an user takes in his mouth to perform exhalation and inhalation, a canister which is filled with carbon dioxide remover to remove carbon dioxide from the breathing air, a breathing bag which is connected to the mouthpiece and the canister and expands and contracts in accordance with the flow in-and-out of breathing air, a duct which serves to connect the mouthpiece to the canister and the breathing bag, an air tank for supplementing fresh air into the breathing circuit, and an air discharge member for discharging surplus breathing air from the breathing circuit, the air discharge member having a number of pores through which the breathing air is reduced to tiny bubbles and discharged as a fine foam.

According to the fourth aspect of this invention, the surplus breathing air which is discharged from the breathing circuit is discharged to the underwater through a number of pores. Accordingly, the discharged breathing air is fined reduced into a fine foam, and thus discharge sound is suppressed. In addition, the whole construction of the apparatus can be simplified.

In order to attain the fifth object of this invention, a semi-closed type of breathing apparatus for removing carbon dioxide from breathing air in a breathing circuit comprises a mouthpiece which an user takes in his mouth to perform exhalation and inhalation, a canister which is filled with carbon dioxide remover to remove carbon dioxide from the breathing air, a breathing bag which is connected to the mouthpiece and the canister and expands and contracts in accordance with the flow in-and-out of breathing air, wherein the breathing bag is designed in such a substantially triangular shape that the sectional area at an upper side thereof is larger than that at an lower side thereof when an user carries the semi-closed type of breathing apparatus on his back, a duct which serves to connect the mouthpiece to the canister and the breathing bag, and an air tank for supplementing fresh air into the breathing circuit.

According to the fifth aspect of this invention, the breathing bag is designed in such a substantially triangular shape that the sectional area of the upper side thereof is larger than that of the lower side when an user carries it on his back. Therefore, the pressure center of the breathing bag is located at a position higher than the center of the breathing bag in the vertical direction. Accordingly, even when the pressure center of the breathing bag is coincident with the pressure center of the lungs of a human, an upper portion of the breathing bag which extends upwardly from the position of these coincident pressure centers can be made small in size. Therefore, the breathing bag is prevented from extending to the head of the user, and the construction of the apparatus can be simplified. In addition, the breathing bag does not obstruct the diving of the user.

DETAILED DESCRIPTION OF THE PREFERRED EMBODIMENTS

Preferred embodiments according to this invention will be described hereunder with reference to the accompanying drawings.

Figure 1:
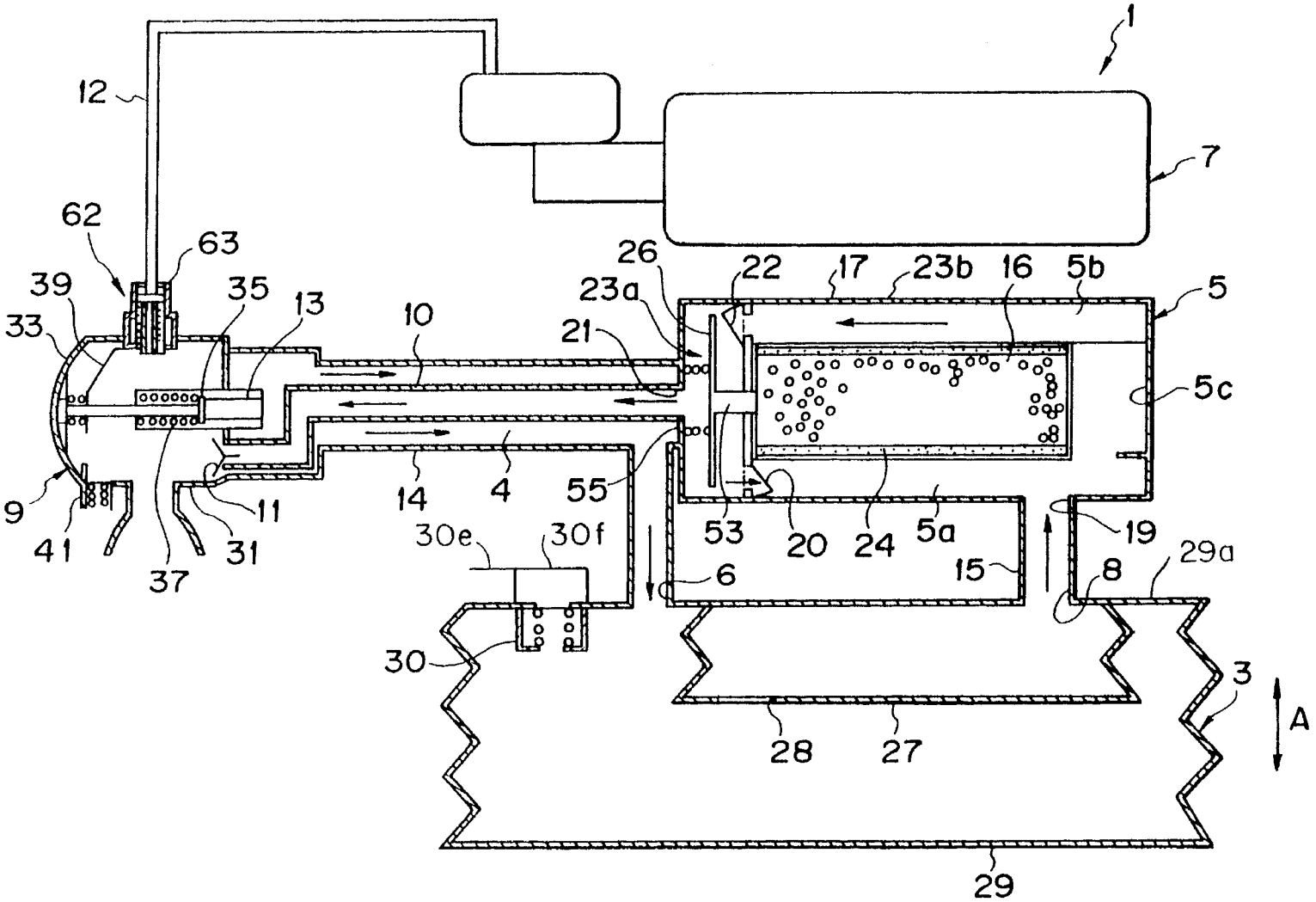
FIG. 1 is a breathing circuit of a semi-closed breathing apparatus according to an embodiment of this invention.

FIG. 1 schematically shows the construction of a semi-closed type of breathing apparatus of an embodiment according to this invention. As shown in FIG. 1, the semi-closed type of breathing apparatus 1 according to this embodiment comprises a breathing bag 3, a canister (carbon dioxide absorber or remover) 5, an air tank 7 and a mouthpiece 9. In an air exhaling operation, breathing air which is exhaled from the mouthpiece 9 is passed through an air exhaling duct 4 and supplied through a flow-in port 6 into the breathing bag 3. On the other hand, in an air inhaling operation, breathing air in a breathing circuit is passed from a flow-out port 8 of the breathing bag 3 through the canister 5 and supplied through an air inhaling duct 10 into the mouthpiece 9. A constant amount of fresh air is supplemented from the air tank 7 through an intermediate-pressure hose 12 to the mouthpiece 9.

The air inhaling duct 10 and the air exhaling duct 4 which are connected to the mouthpiece 9 are in a single duct member 14. The duct member 14 has a double-duct structure in which the air inhaling duct 10 is disposed at an inner side of the duct member 14 and the air exhaling duct 4 is disposed to surround the air inhaling duct 10.

As described above, the air inhaling and exhaling ducts 10 and 4 are designed to be a duct member having the double-duct structure such that the air inhaling duct 10 is disposed inside of the air exhaling duct 4, so that a detaching operation of the semi-closed type of breathing apparatus can be smoothly performed when an user carries it on his back, the overall appearance of the apparatus is not marred and the entire construction of the apparatus can be simplified. Further, substantially only one duct member is connected to the mouthpiece 9, and thus the handling of the semi-closed type of breathing apparatus in the detaching operation can be smoothly performed. In addition, the air inhaling duct 10 and the air exhaling duct 4 are formed into a single hose, so that the whole construction of the apparatus is simplified and the appearance thereof is excellent.

Further, in the double-duct structure, the air inhaling duct 10 is an inside passage and the air exhaling duct 4 is an outer passage surrounding the inside passage, so that even when the air exhaling duct 4 is damaged by an external force or the like, damage of the air inhaling tube 10 at the inner side can be prevented, and thus the air inhaling operation can continue as usual.

Next, the joint between the mouthpiece 9 and the duct member 14 will be described.

Figure 2:
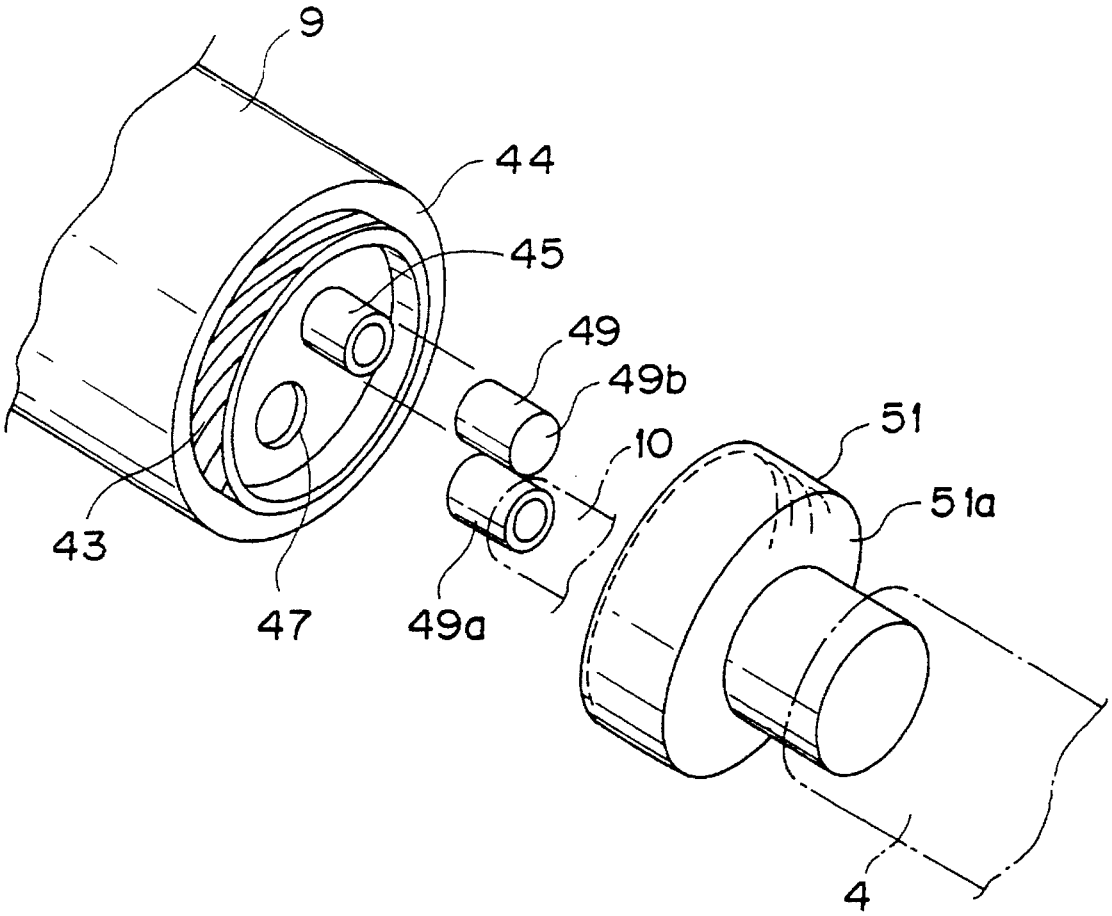
FIG. 2 is a perspective view of a joint state between a mouthpiece and both an exhaling duct and an inhaling duct.
Figure 4:
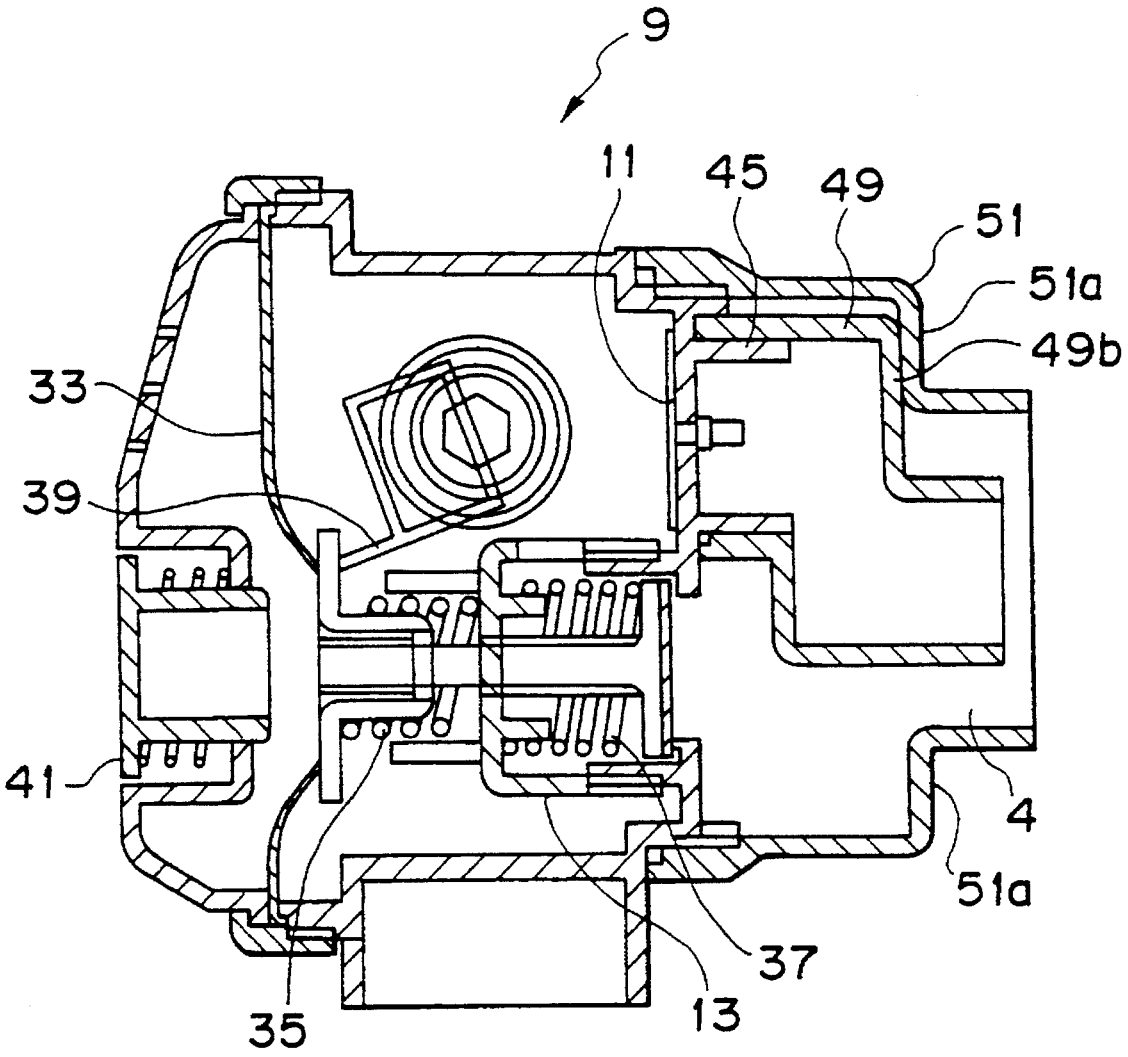
FIG. 4 is a cross-sectional view of a joint sate between the mouthpiece and a joint member.

As shown in FIGS. 2 and 4, an engaging wall 43 having an external screw thread formed on the outer periphery thereof is projected from a side wall 44 of the mouthpiece 9. An air exhaling port 45 is formed at the inner side of the engaging wall 43 so as to project from the side wall 44, and an air inhaling port 47 is formed adjacently to the air exhaling port 45 at the inner side of the engaging wall 43.

The air exhaling port 45 is connected to a link member 49 having two cylindrical members which are stepwisely connected to each other as shown in FIG. 2, and one end 49*a* of the link member 49 is connected to the flexible air inhaling duct 10. Utilizing this link member 49, the air inhaling duct 10 can be connected to the substantially central portion of the side wall 44 of the mouthpiece.

The engaging wall 43 is engaged with a coupler member 51 having an internal screw thread formed on the inner periphery thereof. The link member 49 is pressed against the air exhaling port 45 by pressing the end wall 51*a* of the coupler member 51 against one end surface 49*b* of the link member 49, so that the link member 49 is secured to the air exhaling port 45.

Figure 3:
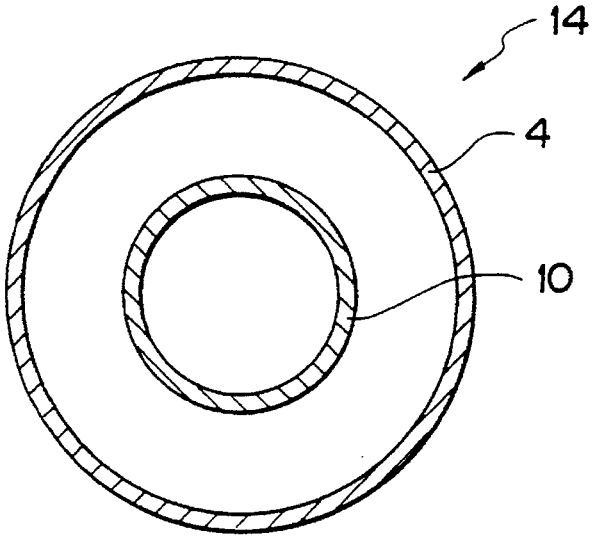
FIG. 3 is a cross-sectional view of a double-duct structure of the exhaling and inhaling ducts.

The air exhaling duct 4 is connected to the substantially central portion of the coupler member 51, and the air inhaling duct 10 is connected to the link member 49 located at the inner side of the coupler member 51. Accordingly, the duct member 14 has a double-duct structure in which the air inhaling duct 10 is disposed inside of the air exhaling duct 4 as shown in FIG. 3.

As shown in FIG. 1, the canister is connected to both the breathing bag 3 and the air inhaling duct 10. An air inhaling duct 15 is connected to an air inhaling port 19 provided at one side of the canister 5, and the air inhaling duct 10 as described above is connected to an air inhaling port 21 of the canister 5. An absorber cartridge 16 filled with carbon dioxide absorber is accommodated in the canister 5, and an air flow-in passage 5*a* is formed at one side of the canister 5 while an air flow-out passage 5*b* is formed at another side of the canister 5.

The air flow-in passage 5*a* is provided with a drain valve 20 for receiving water which leaks in from the air inhaling duct 10, so that even if water leaks into the canister, the water is guided to a water tank 5*c*. On the other hand, the flow-out passage 5*b* is provided with a water-flow preventing valve 22 for preventing the water from flowing into it. The absorber cartridge 16 is provided with a water-absorbing sponge 24 at the flow-in passage 5*a* side, whereby some amount of the water is absorbed by the sponge 24 before the water reaches the carbon dioxide absorber.

The canister 5 is provided with a nonload preventing valve 26 for the absorber cartridge 16, which serves to close the flow-in passage 5*a* and the flow out passage 5*b* when the absorber cartridge 16 is misloaded into the canister 5 (the user forgets that no cartridge 16 is loaded in the canister 5).

Next, the relationship between the canister 5 and the nonload preventing valve 26 will be described with reference to FIG. 5.

The canister 5 comprises a loading equipment 23*a* into which the canister cartridge 16 is loaded, and a case 23*b* for covering the canister cartridge 16. The loading equipment 23 is connected to the air inhaling duct 10 and the air tank 7. The air inhaling duct 10 is connected to the air inhaling port 21 formed in the loading equipment 23*a*. The breathing bag 3 is connected through the air inhaling duct 15 to the air inhaling port 19 provided at one side of the case 23*b*.

The loading equipment 23*a* is provided with the nonload preventing valve 26 for closing the passage 18 of the breathing circuit (or the flowing passage 5*a* and flow-out passage 5*b*) when the canister cartridge 16 is nonloaded (that is, the user forgets that no cartridge has been loaded). The nonload preventing valve 26 includes an open-and-close member 50 for opening and closing the passage 18 of the breathing circuit, and a projective moving member 53 (moving means) for moving the open-and-close member 50 when the canister cartridge 16 is loaded, these members 50 and 53 being integrally formed with each other. The open-and-close member 50 is designed in a disc shape so as to close the passage 18. The moving member 53 is designed to project from the center portion of the open-and-close member 50 toward the case 23*b*, and guided along guide holes formed in partition walls 57*a* and 57*b*.

Further, a coil spring (urging means) 55 for urging the open-and-close member 50 to close the passage 18 of the breathing circuit is provided to the air exhaling port 21 of the loading equipment 23*a*. With the loading equipment 23*a* thus constructed, when no canister cartridge 16 is loaded, the open-and-close member 50 is urged by the coil spring 55 to be kept in a closed state where the passage 18 of the breathing circuit is closed.

The open-and-close member 50 and the moving means 53 may be formed separately (individually) from each other, and any member may be used as the moving means 53 insofar as it detects the loading of the canister cartridge 16 and moves the open-and-close member 50.

Figure 13:
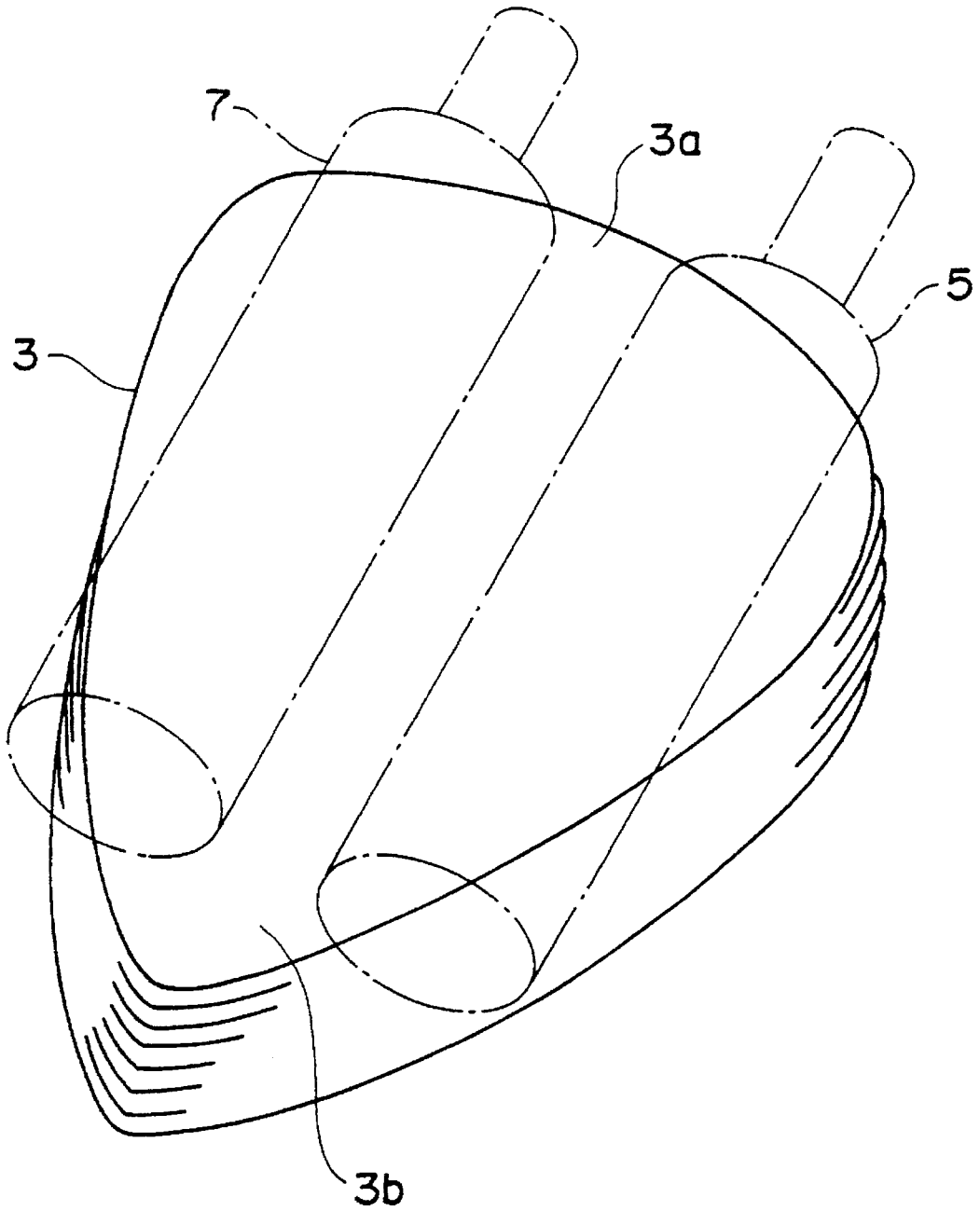
FIG. 13 is a perspective view of a breathing bag of the embodiment of this invention.
Figure 14A:
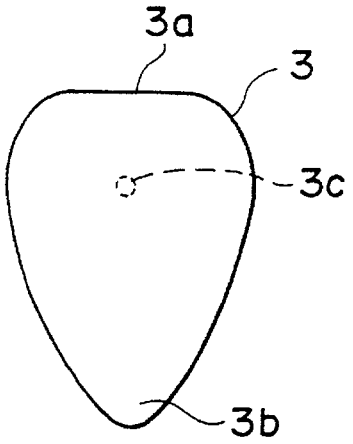
FIGS. 14(*a*) and 14(*b*) are plan and side views showing the position of a pressure center of the breathing bag of this embodiment.
Figure 14B:
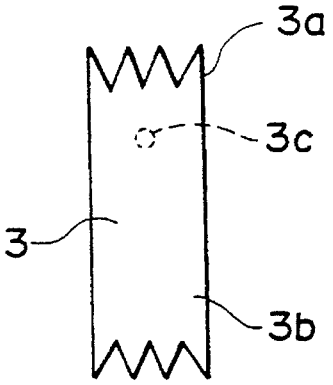
Figure 15A:
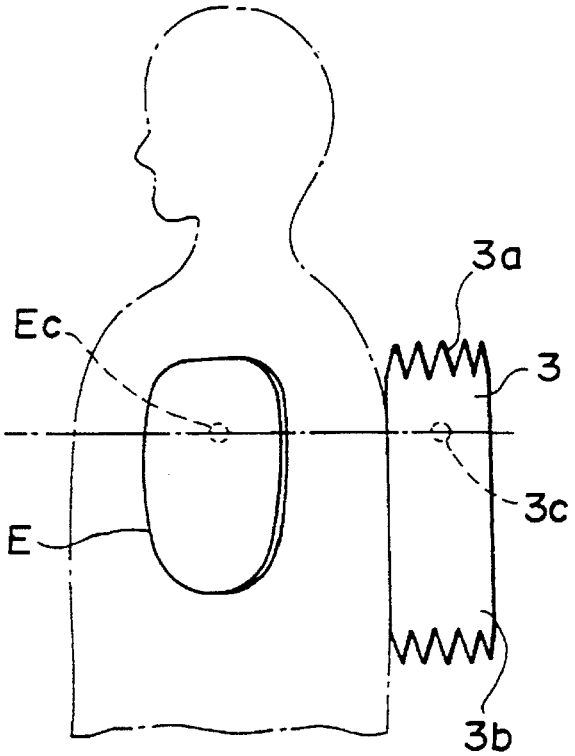
FIGS. 15(*a*) and 15(*b*) are side and plan views showing an action of the breathing bag of the semi-closed type of breathing apparatus of the embodiment according to this invention.
Figure 15B:
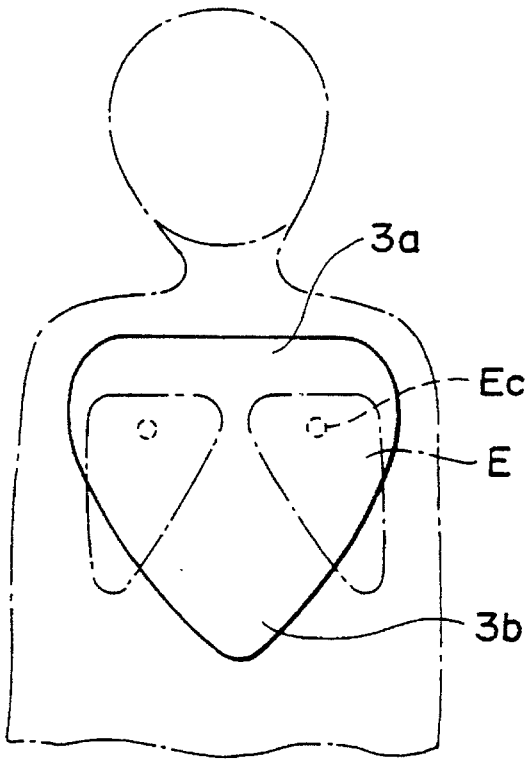
Figure 16A:
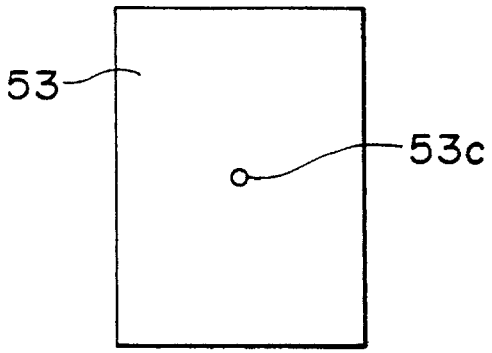
PRIOR ART FIG.16(a)
FIGS. 16(*a*) and 16(*b*) are plan and side views showing the position of a pressure center of a conventional breathing bag.
Figure 16B:
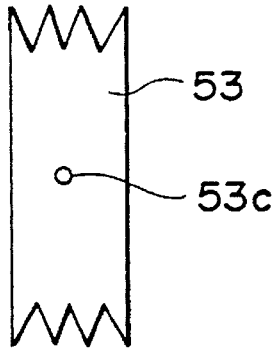
Figure 17A:
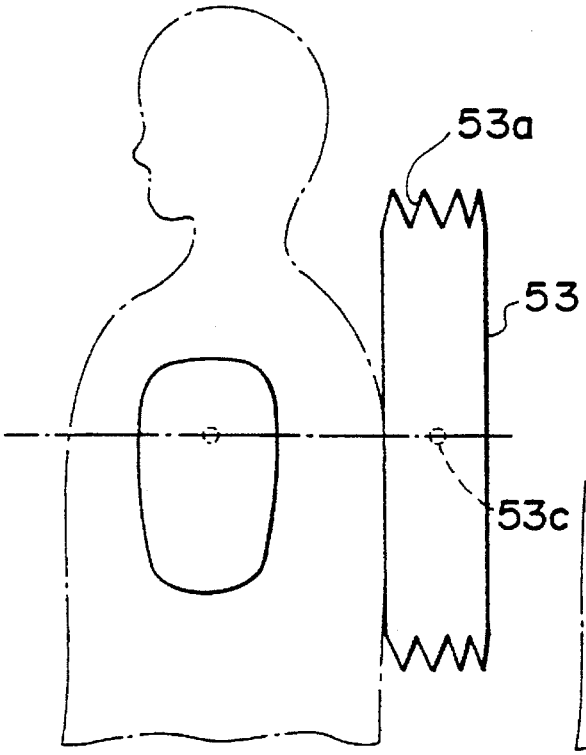
PRIOR ART FIG.17(a)
FIGS. 17(*a*) and 17(*b*) are side and plan views showing a problem of the conventional breathing bag.
Figure 17B:
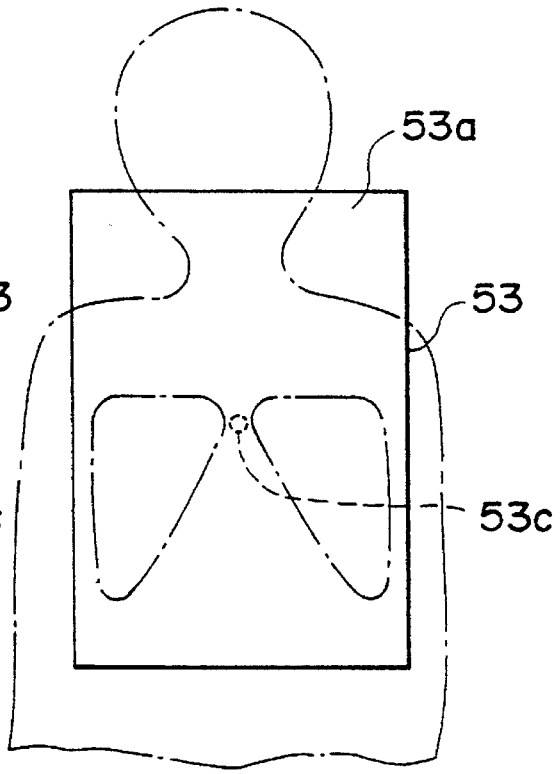

As shown in FIGS. 13–15(*b*), the breathing bag 3 is designed in a substantially triangular shape so that the upper side portion 3*a* thereof (nearer to the head of an user) is wider than the lower side portion 3*b* thereof (nearer to the waist of the user). Accordingly, the volume at the upper side 3*a* of the breathing bag is larger than that at the lower side 3*b* thereof. The total volume of the breathing bag 3 is set to be substantially equal to the volume of the lungs of a man. The breathing bag 3 is disposed so that the pressure center Ec of the lungs of a human is substantially coincident with the pressure center 3*c* of the breathing bag, and it is beforehand fixed or disposed at such a position by a float adjusting device or the loading equipment. As described above, the pressure center Ec of the lungs of a human is located at the position which is substantially coincident with the pressure center 3*c* of the breathing bag, so that a load in a breathing operation which would occur due to incoincidence between these pressure centers can be reduced.

Further, since the breathing bag is a substantially triangular shape like the lungs of the human, the pressure center 3*c* of the breathing bag is located at a position which is higher than the middle position in the vertical direction of the breathing bag 3. Accordingly, even when the pressure center of the lungs of the user is coincident with the pressure center 3*c* of the breathing bag 3, a part of the breathing bag 3 which extends from the position of the pressure center 3*c* toward the head of the user is small, and thus it does not reach the head of the user and it does obstruct the motion of the user.

The breathing bag 3 is not necessarily required to have a triangular shape, and it may be designed in any shape to obtain the same effect insofar as the sectional area of the upper side 3*a* of the breathing bag 3 is larger than that the lower side 3*b* thereof when the user carries it on his back. For example, it may be designed in a trapezoidal shape or other shape.

The breathing bag 3 includes a bag body 29 and an inside bag 27 as shown in FIG. 1. The inside bag 27 is provided inside of the bag body 29 so as to cover a flow-out port 8, and an intercommunication hole 28 which intercommunicates with a flow-in hole is formed at a position away from the flow-out port 8. As described above, in this embodiment, the flow-out port 8 and the intercommunication hole 28 are formed away from each other, and thus even when water leaks into the bag body 29, it is more difficult for the water to invade through the intercommunication hole 28 into the inside breathing bag 27. Likewise, water flowing out from the flow-out port 8 can be prevented from invading into the flow-in port 6.

The inside breathing bag 27 as well as the bag body 29 is formed of elastic material such as rubber in a bellows shape, and they expand and contract in a direction as indicated by the double-headed arrow A when the breathing air flows in and out.

As shown in FIG. 1, the base 29*a* of the bag body 29 is provided with the flow-in port 6 and the flow-out port 8, and further provided at one side thereof with a valve unit 30 for discharging the breathing air in the bag body 29. The valve unit 30 serves to discharge the breathing air when the bag body 29 expands and a predetermined amount of breathing air is stored.

Figure 8:
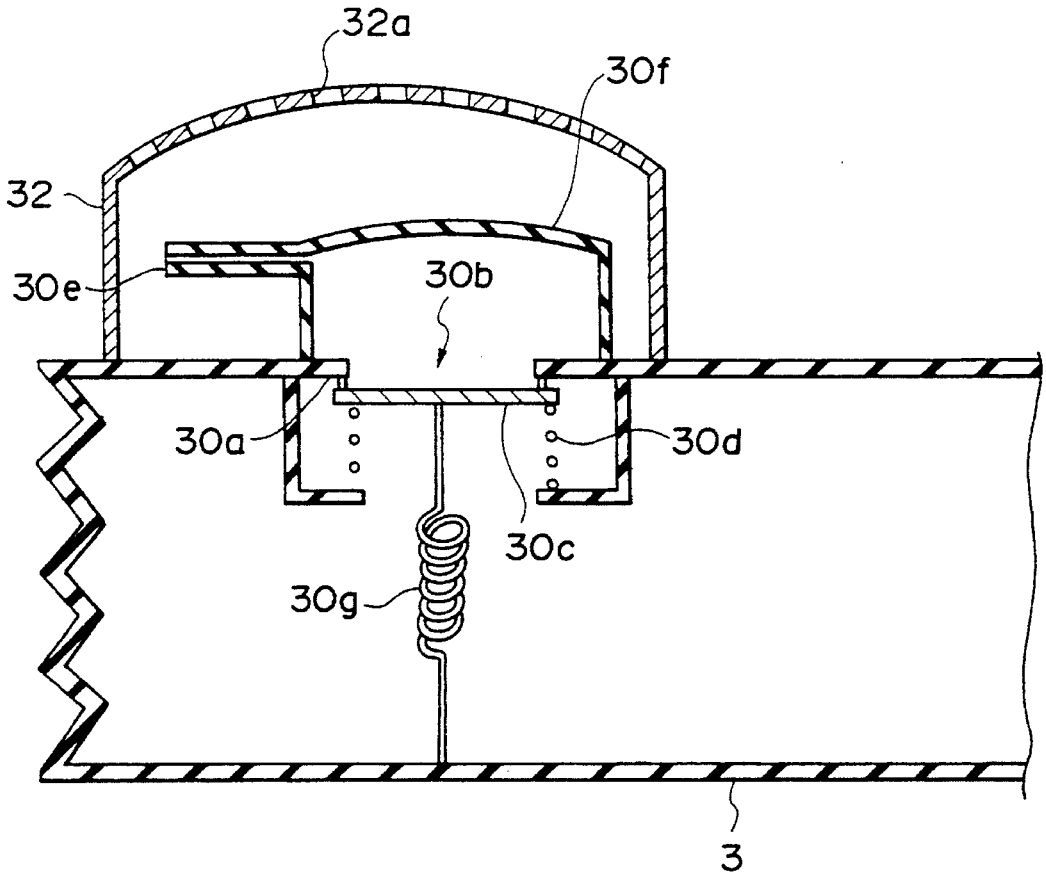
FIG. 8 is an enlarged cross-sectional view of a valve unit of the semi-closed type of breathing apparatus shown in FIG. 1.
Figure 9:
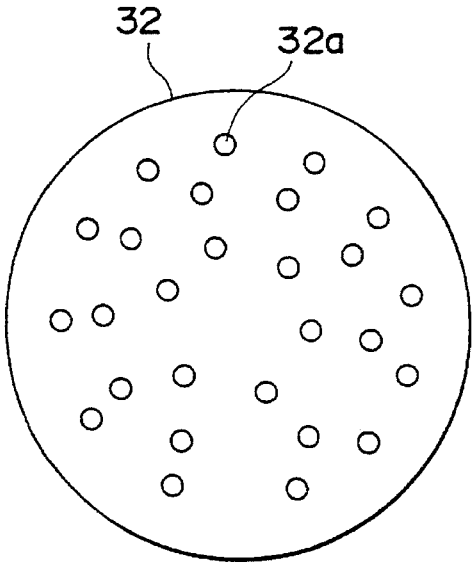
FIG. 9 is a plan view of a cover having holes formed therein.

As shown in detail in FIGS. 8 and 9, the valve unit 30 includes a valve plug 30*c* for closing a valve port 30*b* when it sits on a valve seat 30*a*, a spring 30*d* for urging the valve plug 30*c* against the valve seat 30*a*, and a cable member 30*g* whose one end is connected to the breathing bag 3 and serves to move the valve plug 30*c* against the spring 30*d* when the breathing bag expands by a predetermined amount or more. The valve port 30*b* is provided with a valve case 30*f* having a discharge slit 30*e*. A cover 32 having a number of pores 32*a* is provided outside of the valve case 30*f* so as to cover the valve case 30*f*, surplus air which is discharged from the discharge slit 30*e* is discharged as an infinite number of tiny bubbles or a fine foam through the pores 32*a*.

Since the discharged surplus air is reduced to a fine foam as described above, a discharge sound hardly occurs or is reduced, so that occurrence of a conventional big bubbling sound like "hubble-hubble" can be prevented. Accordingly, even when an user approaches underwater living things such as fish, etc. for the purpose of underwater observation or the like, they do not escape from the user. Further, since the air to be discharged is gradually discharged while reduced to a foam, and variation in buoyancy is smaller than when the air is discharged at the same time, and thus the user can easily keep the underwater balance when he carries the breathing apparatus on his back.

Figure 10:
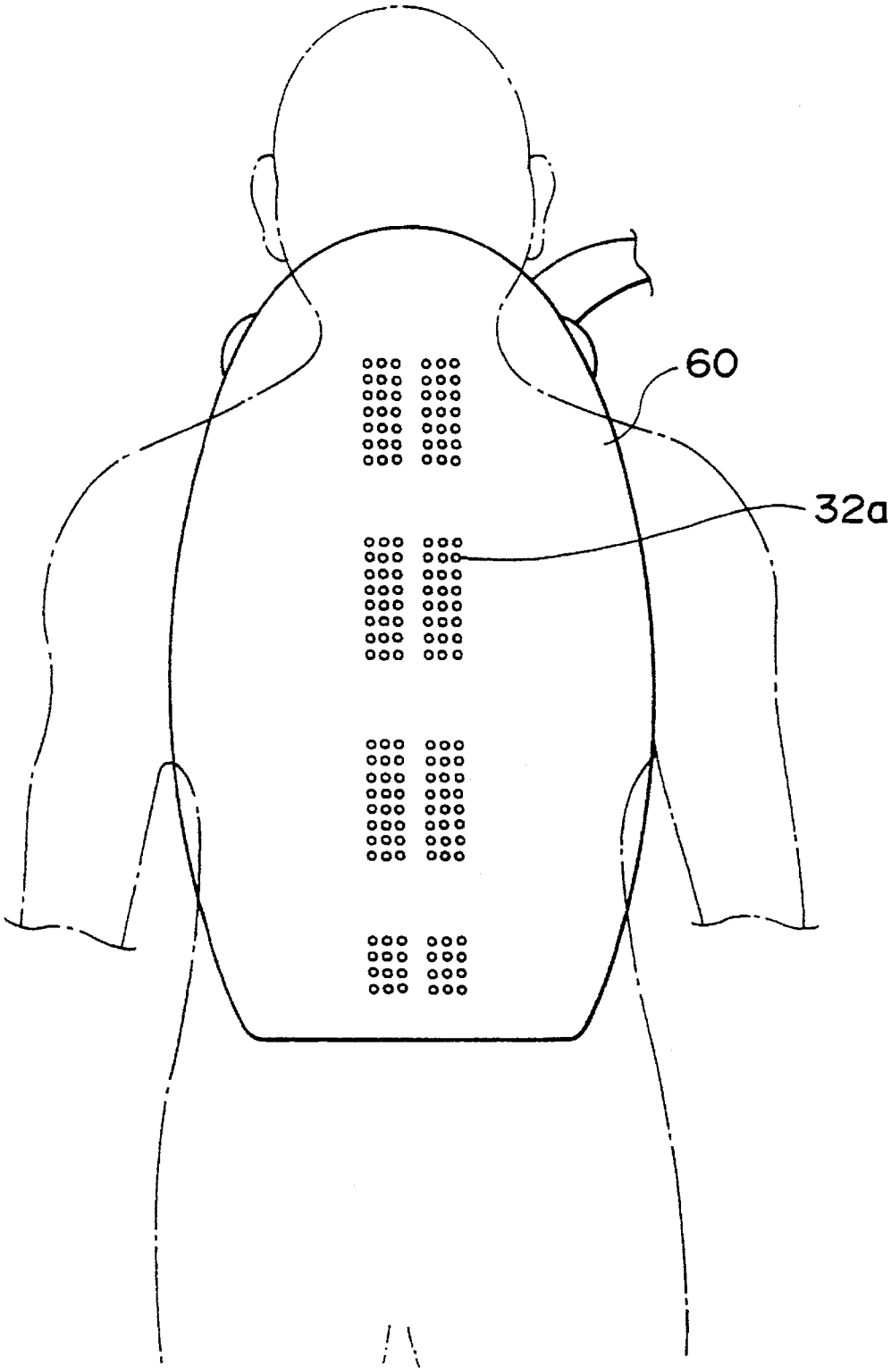
FIG. 10 is a plan view of a case of a semi-closed type of breathing apparatus according to another embodiment of this invention.
Figure 11:
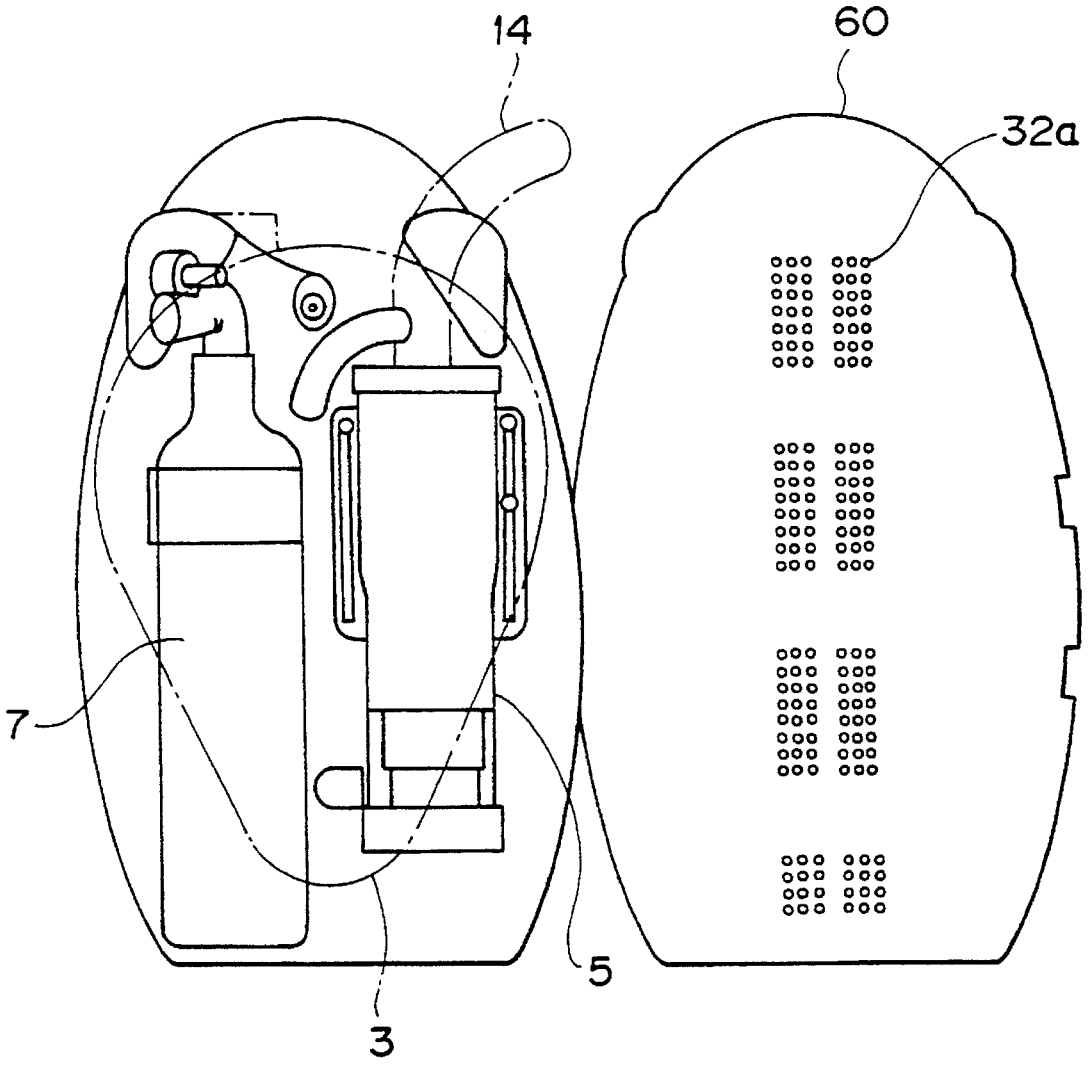
FIG. 11 is a plan view of a state where the case shown in FIG. 10 is opened.
Figure 12:
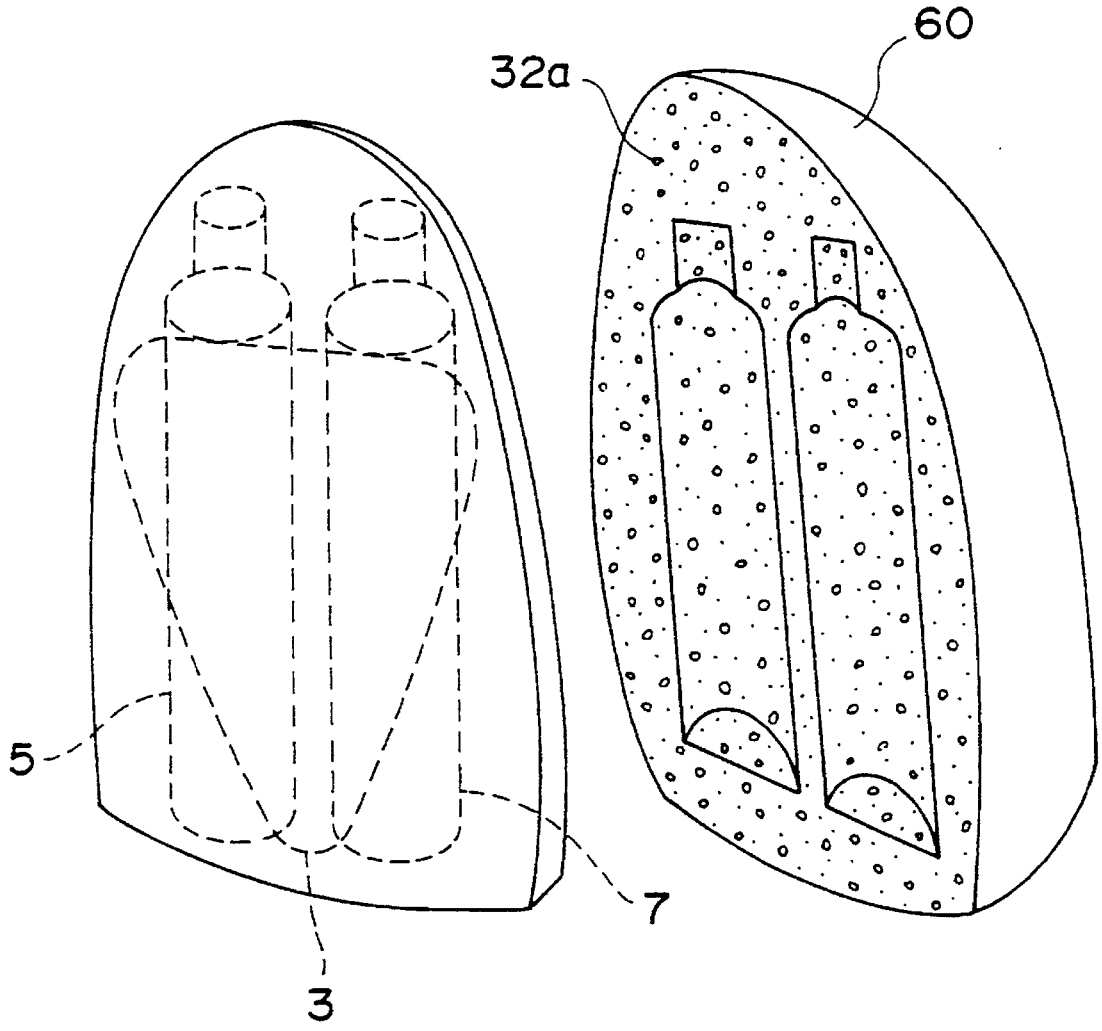
FIG. 12 is a plan view of a case of a semi-closed type of breathing apparatus according to another embodiment of this invention.

The same effect can be obtained using the construction as shown in FIGS. 10 to 12 to reduce the discharged air to a foam.

In an embodiment shown in FIGS. 10 and 11, the canister 5, the breathing bag 3, the air 7, etc. are accommodated in a case 60 of the semi-closed type of breathing apparatus, and a number of pores 32*a* are formed at the front surface of the case 60. In this embodiment, since the pores are formed in the case 60, a special member having pores is not required, so that the construction can be simplified.

In an embodiment shown in FIG. 12, the whole construction of the case of the semi-closed type of breathing apparatus is formed of porous material such as sponge or the like. When the sponge is used for the case itself as described above, a process of forming pores is not required. In addition, it is light in weight and it can contract when it is unused, so that it is convenient to be carried.

As shown in FIG. 1, the mouthpiece 9 includes an air inhaling valve 11 and an air exhaling valve 13, and each of the air inhaling and exhaling valves 11 and 13 comprises a check valve. In the air inhaling operation, only the air inhaling valve 11 is opened. On the other hand, in the air exhaling operation, only the air exhaling valve 13 is opened. The On and Off valve operation of the air exhaling valve 13 is performed by a diaphragm.

The mouthpiece 9 is provided with a diaphragm 33 at one side of a casing 31 thereof, and the diaphragm is designed to expand in accordance with an inner pressure of the casing 31.

The air exhaling valve 13 includes an exhaling valve plug 35, and a coil spring 37 serving as urging means for urging the exhaling valve plug 35 in such a direction as to close the air exhaling valve 13. When the exhaling valve plug 35 sits on, the air exhaling port of the air exhaling duct 4 is closed. The rear end portion of the exhaling valve plug 35 is connected to the diaphragm 33, and in accordance with expansion of the diaphragm 33, the exhaling valve plug 35 is moved against an urging force of the coil spring 37 to open the air exhaling port. The inhaling valve 11 is formed of flexible material and is provided at the air inhaling port connected to the air inhaling duct 10, and the flexible inhaling valve 11 is deformed in accordance with the inner pressure of the casing 31 to open the air inhaling port.

The casing 31 is further provided with a demand mechanism 62 for supplying, from the breathing air tank to the mouthpiece, an intermediate-pressure breathing air which is higher in pressure than the inner pressure of the breathing circuit, if necessary.

Figure 6:
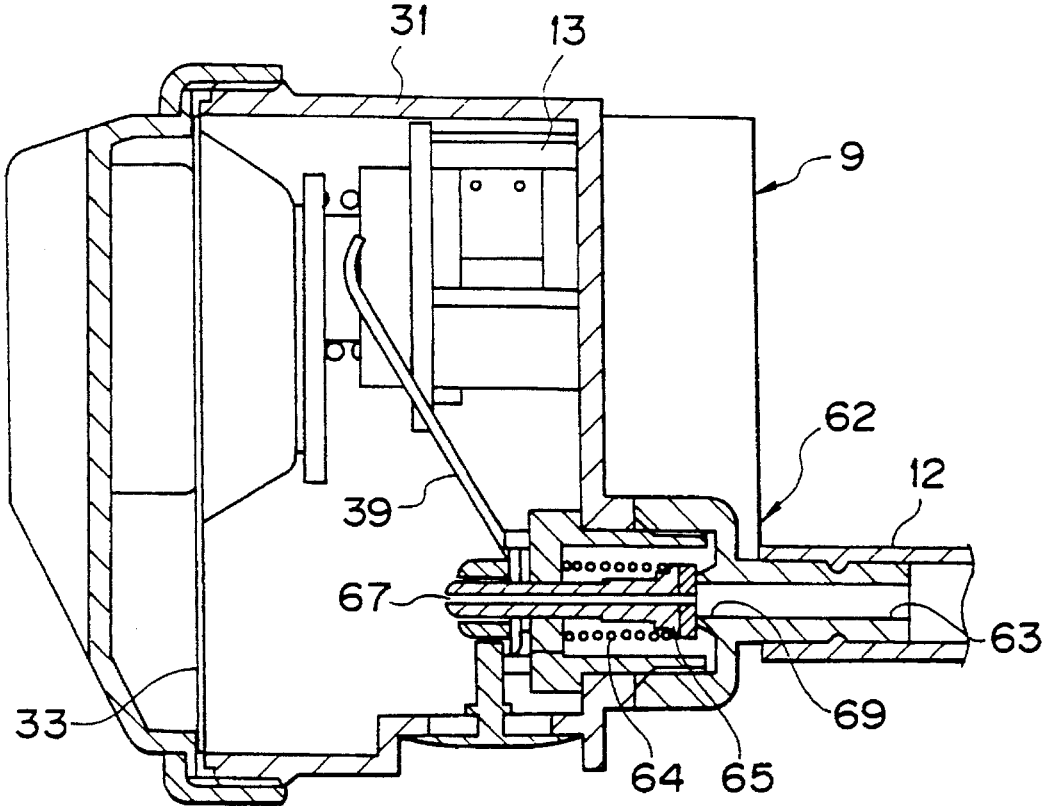
FIG. 6 is a cross-sectional view of a mouthpiece shown in FIG. 1.
Figure 7:
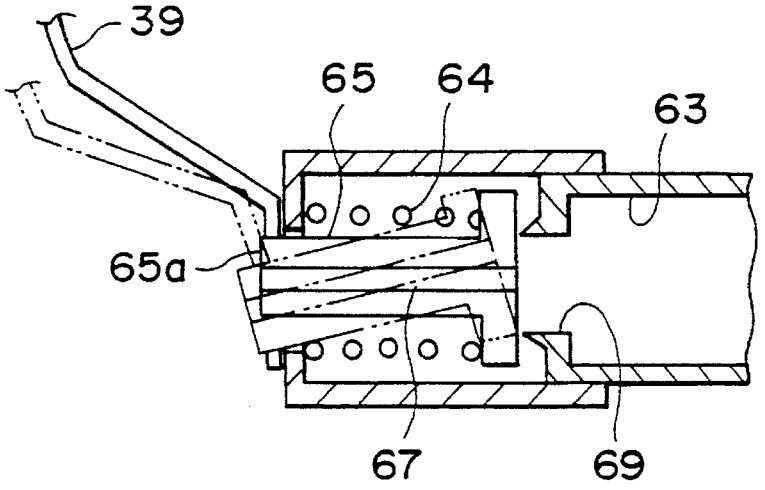
FIG. 7 is a schematic view of a demand mechanism shown in FIG. 6.

The demand mechanism 62 comprises an intermediate-pressure hose 12 into which an intermediate-pressure breathing air is introduced from the air tank 7, a connection nipple 63 connected to the intermediate-pressure hose 12, and a valve plug 65 for opening and closing the connection nipple 63 as shown in FIGS. 6 and 7. The valve plug 65 is formed with an intercommunication hole 67 through which the connection nipple 63 is intercommunicated to the mouthpiece 9.

The connection nipple 63 is provided with a valve seat 69, and a spring 64 for urging the valve plug 65 is provided to the valve seat 69. The tip portion of the valve plug 65 is projected into the mouthpiece 9, and is connected to one end portion of a lever 39 which is linked to the diaphragm 33, whereby the tip portion of the valve plug 65 is displaced when the diaphragm 33 is deformed by a predetermined amount or more.

With the construction of the demand mechanism 62 as described above, the low-pressure breathing air is supplemented into the breathing circuit at all times while the demand mechanism 62 is closed, and when the pressure in the mouthpiece 9 is lowered, the demand mechanism 62 is opened to purge the breathing air.

Accordingly, the low pressure and the intermediate pressure for purge are supplied with only one intermediate-pressure hose 12, so that the construction of the apparatus can be simplified. In addition, two kinds of functions can be provided to the demand mechanism 62 with the simple construction that the valve plug 65 of the demand mechanism 62 is formed with the intercommunication hole 67, and the whole construction of the apparatus can be further simplified.

As shown in FIG. 1, the casing 31 is further provided with a dischange valve 41 for discharging water which has leaked into the casing. The dischange valve 41 comprises a drain valve plug for closing a drain port when it sits on the drain port, and a coil spring for urging the drain valve plug, and the drain port is opened by pressing the valve plug against an urging force of the coil spring.

Next, the operation of the breathing apparatus according to this embodiment will be described.

As shown in FIG. 1, when an user takes the mouthpiece 9 in his mouth and exhales the air, the air inhaling valve 11 of the mouthpiece 9 is closed, and the exhaling valve 13 is opened, so that the exhaled air flows through the exhaling duct 4 into the breathing bag 3. Through this operation, the bag body 29 is expanded in the direction as indicated by the double-headed arrow A in the.

Subsequently, when the user inhales the air, the inhaling valve 11 of the mouthpiece 9 is opened and the air exhaling valve 13 is closed. Therefore, the breathing bag 3 contracts and the breathing air in the breathing bag 3 flows through the flow-out port 8 into the canister 5.

In the air inhaling operation, the breathing air in the breathing circuit flows from the flow-out port 8 of the breathing bag 3 into the canister 5, and carbon dioxide contained in the breathing air is removed by the carbon dioxide absorber in the canister 5. Thereafter, the breathing air is supplied through the air inhaling duct 10 into the mouthpiece 9.

The air inhaling duct 10 and the air exhaling duct 4 which are connected to the mouthpiece 9 are integrally formed as a single hose having a double-duct structure. Therefore, the user can smoothly handle the breathing apparatus when he detaches it from his back, the whole construction of the apparatus is simplified, and the appearance of the apparatus is excellent.

Further, the air inhaling duct 10 is disposed inside of the air exhaling duct 4, so that even when the duct is damaged from the external side, only the air exhaling duct 4 is priorly damaged, and there is little probability that the air inhaling duct 10 is damaged. Therefore, the air inhaling operation can be continued.

For use of the semi-closed type of breathing apparatus 1, the case **23*b* is detached from the load equipment 23 of the canister 5 and the canister cartridge 16 is loaded before an user carries the breathing apparatus 1 on his back. At the time when the canister cartridge 16 is loaded, the canister cartridge 16 presses the moving member 53 projecting from the load equipment 23 against the urging force of the spring 55, and moves the moving member 53. Since the moving member 53 is unified to the open-and-close member 50, the passage 18 of the breathing circuit is opened through the movement of the open-and-close member 50. That is, when the canister cartridge 16 is loaded, the passage 18 of the breathing circuit is opened, and the breathing circuit is intercommunicated with the canister 5. After the canister cartridge 16 is loaded, the case 23*b* is engagedly secured to the load equipment 23*a*** and the canister is sealed.

As described above, when the breathing circuit is intercommunicated, the breathing air which is exhaled from the mouthpiece 9 is passed through the air exhaling duct 4, and supplied through the flow-in port 6 into the breathing bag 3. In the air inhaling operation, the breathing air in the breathing circuit is passed from the flow-out port 8 of the breathing bag 3 through the canister 5 and the air inhaling duct 10 into the mouthpiece 9.

Figure 5:
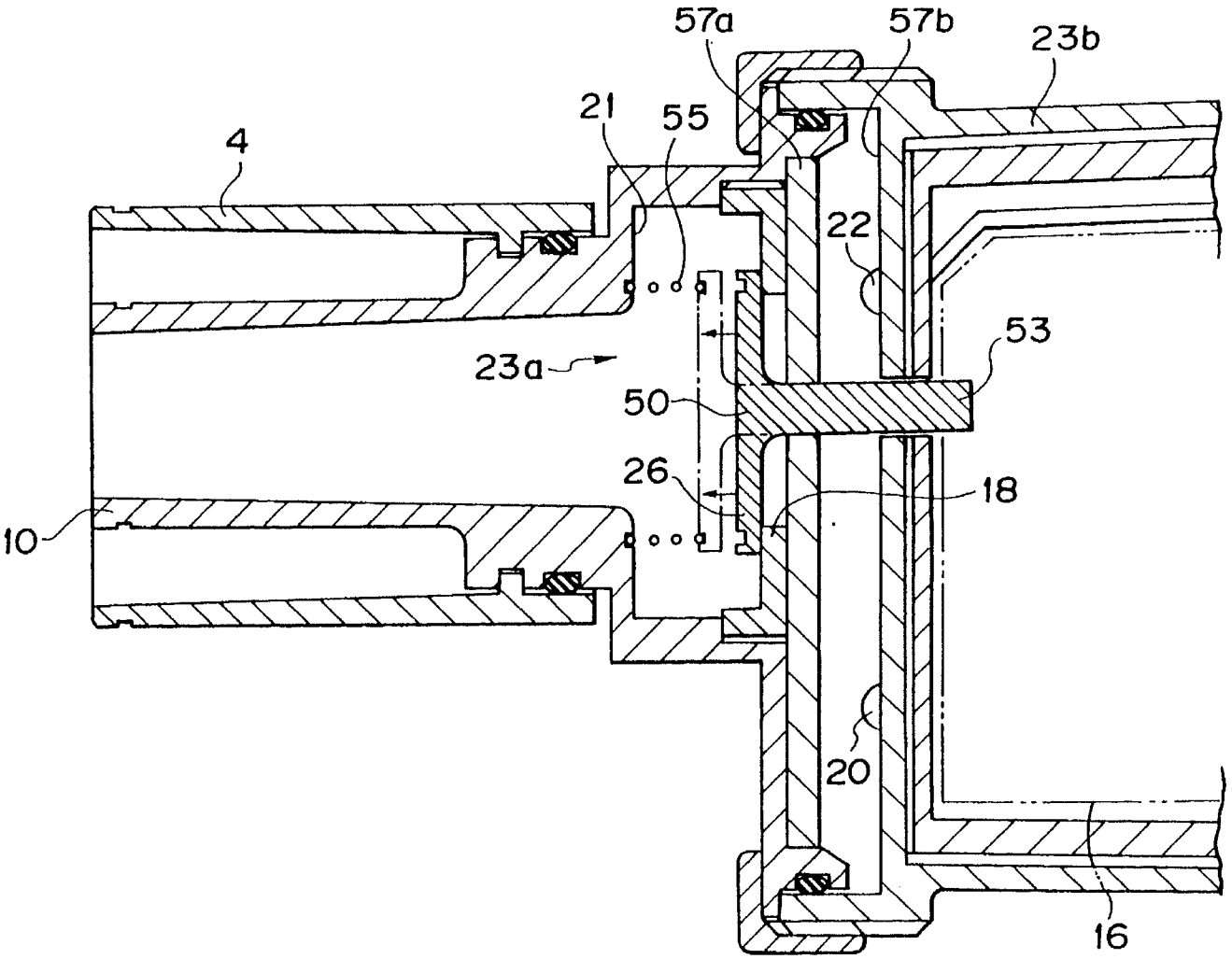
FIG. 5 is a cross-sectional view showing the construction of a loading equipment in a canister shown in FIG. 1.

On the other hand, when the user forgets to load the canister cartridge 16 into the canister 5, the open-and-close member 50 is kept in a state where it closes the passage 18 of the breathing circuit through the spring 55 in the load equipment **23*a* of the canister 5 as indicated by a solid line of FIG. 5. Accordingly, even when the user carries the breathing apparatus 1 on his back in the above state and he takes the mouthpiece in his mouth for breathing, he cannot breathe in because the breathing circuit is closed. Therefore, the user is aware that no canister cartridge 16** is loaded into the canister, and it can be prevented for the user to dive with the breathing apparatus having no canister cartridge.

On the other hand, the intermediate-pressure breathing air, for example, the breathing air whose pressure is higher than the environmental pressure (the inner pressure of the breathing circuit) by 10 to 12 ($Kg/cm^2$) is supplied from the air tank 7 through the intermediate-pressure hose 12 to the demand mechanism 62 at all times. As shown in FIG. 6, in the demand mechanism 62, the valve plug 65 sits on the valve seat 69 while urged by the spring 64, and the intermediate-pressure air is passed through the intercommunication hole 67, and blown into the mouthpiece 9. The blown-in breathing air is supplied while the pressure thereof is set to be substantially equal to the inner pressure of the breathing circuit.

Accordingly, in the semi-closed type of breathing apparatus of this embodiment, the low-pressure breathing air is supplied into the breathing circuit at all times while the demand mechanism 62 is kept in the close state.

When the pressure in the mouth piece 9 is reduced, the demand mechanism 62 is opened to purge the air.

That is, when the pressure in the mouthpiece is reduced and thus the diaphragm 33 is deformed toward the inside of the mouthpiece 9, and the lever 39 is displaced as indicated by a two-dotted chain line of FIG. 3, so that the tip portion 65*a* of the valve plug 65 which is connected to one end portion of the lever is pressed in a direction intersecting to the urging direction of the spring 64 to thereby displace the valve plug 65. Through this operation, a part of the valve plug 65 is moved separately from the valve seat 69, and the intermediate-pressure air is purged into the connection nipple 63.

On the other hand, in a fabrication process of the semi-closed type of breathing apparatus, it is sufficient that only the intermediate-pressure hose 12 is connected from the air tank 7 to the demand mechanism. Therefore, as compared with a conventional semi-closed type of breathing apparatus which requires a process of securing two hoses of an intermediate-pressure hose and a low-pressure hose, the fabrication process of the semi-closed type of breathing apparatus of this invention is more easily performed, and the working performance is greatly improved.

The breathing bag 3 expands and contracts in accordance with a breathing action of the user. When the breathing bag 3 is stretched by a predetermined amount (corresponding to the length of the cable member 30*g*) or more, the valve plug 30*c* is separated from the valve seat 30*a* against the spring 30*d*, the value 30*b* is opened, and surplus air is discharged from the breathing bag 3. The surplus air which is discharged from the valve port 30*b* is discharged through the slit 30*e* of the valve case 30*f*. The air thus discharged is not directly guided to the underwater, but passed through the pores 32*a* of the cover 32 to the underwater. Accordingly, the discharged air (surplus breathing air) is discharged to the underwater while being reduced to a foam by the pores 32*a*.

Since the discharged water is reduced to a foam as described above, occurrence of the discharge sound is suppressed, or the discharge sound is also reduced, so that fish do not escape from the user (diver), and the underwater balance can be easily maintained.

Further, since the breathing bag 3 is located at such a position that the pressure center Ec of the lungs of a human is substantially coincident with the pressure center 3*c* of the breathing bag, the pressure center Ec of the lungs of the human is substantially coincident with the pressure center 3*c* of the breathing bag. Therefore, a load in the breathing action is reduced, and thus the user can smoothly and easily breathe in and out.

What is claimed is:

1. A semi-closed type of breathing apparatus which removes carbon dioxide from breathing air, comprising:

a mouthpiece which is a breathing circuit adapted to be positioned in a user's mouth for exhalation and inhalation;

a canister filled with carbon dioxide remover to remove carbon dioxide from breathing air;

a breathing bag which is connected to said mouthpiece and said canister, and expands and contracts in accordance with flow in-and-out of breathing air;

a double-duct hose which connects said mouthpiece to said canister and said breathing bag and comprises an inner duct, which is connected to and communicates with said canister, for air inhalation and an outer duct for air exhalation, said outer duct surrounding said inner duct and being connected to and communicating with said breathing bag; and an air tank for supplementing air in the breathing circuit.

2. The semi-closed type of breathing apparatus as claimed in claim 1, wherein said inner duct is smaller in diameter than said outer duct, and said inner and outer ducts are disposed concentrically with each other.

3. The semi-closed type of breathing apparatus as claimed in claim 2, wherein said mouthpiece is provided with an air inhaling port connected to said inner duct and an air exhaling port connected to said outer duct, said air inhaling and exhaling ducts being juxtaposed with each other, and wherein said outer duct is connected to a coupler member which is operative to engage with said mouthpiece, and said air inhaling port and said inner duct are connected to each other through a link member, so that said outer duct is intercommunicated with said air exhaling port when said coupler member is engaged with said mouthpiece.

4. The semi-closed type of breathing apparatus as claimed in claim 3, wherein said link member includes an engaging member which is contacted with said coupler member and pressed against said coupler member when said coupler member is engaged with said mouthpiece, the connection between said inner duct and said air inhaling port thereby being kept tight.

5. A semi-closed type of breathing apparatus which removes carbon dioxide from breathing air, comprising:

a mouthpiece which is a breathing circuit adapted to be positioned in a user's mouth for exhalation and inhalation;

a canister filled with carbon dioxide remover to remove carbon dioxide from breathing air, said canister comprising a case, an outlet passage communicating said canister with the breathing circuit, and loading equipment into which a cartridge having carbon dioxide remover therein is loaded, wherein said loading equipment includes a closing member for closing said outlet passage of said canister and in turn closing the breathing circuit to prevent a user from breathing when no cartridge is loaded, urging means for urging said closing member to close the outlet passage, and moving means for moving said closing member against said urging means when the cartridge is loaded, thereby opening the outlet passage;

a breathing bag which is connected to said mouthpiece and said canister, and expands and contracts in accordance with flow in-and-out of breathing air;

a duct through which said mouthpiece is connected to said canister and said breathing bag; and an air tank for supplementing air in the breathing circuit.

6. The semi-closed type of breathing apparatus as claimed in claim 5, wherein said closing member comprises a flat plate for opening and closing the outlet passage, and a projection which is integrally formed with said flat plate and projects from said flat plate to a cartridge side, when the cartridge is located into said case, said projection being moved against said urging means to thereby open the outlet passage of said canister.

7. The semi-closed type of breathing apparatus as claimed in claim 6, wherein said outlet passage is provided with an one-way valve for preventing leakage of water into the outlet passage, said closing member being overlapped with said one-way valve to close said one-way valve.

8. A semi-closed type of breathing apparatus which removes carbon dioxide from breathing air, comprising:

a mouthpiece which is a breathing circuit adapted to be positioned in a user's mouth for exhalation and inhalation;

a canister filled with carbon dioxide remover to remove carbon dioxide from breathing air;

a breathing bag which is connected to said mouthpiece and said canister, and expands and contracts in accordance with flow in-and-out of breathing air;

a duct which serves to connect said mouthpiece to said canister and said breathing bag;

an air tank for supplementing air in the breathing circuit; and a demand mechanism on said mouthpiece and with which intermediate-pressure breathing air whose pressure is higher than the inner pressure of said breathing circuit is purged from said air tank into said mouthpiece when occasion demands, wherein said demand mechanism comprises a connection nipple to which an intermediate-pressure hose is connected, and a valve plug which serves to open and close said connection nipple, said valve plug being provided with an intercommunication hole which is intercommunicated with said connection nipple and supplies low-pressure air, the low-pressure air being supplied through said intercommunication hole into said breathing circuit at all times in a state where the valve plug is closed, wherein when a purging operation is carried out the valve plug is opened to introduce the intermediate-pressure air into said breathing circuit.

9. The semi-closed type of breathing apparatus as claimed in claim 8, wherein said mouthpiece includes a diaphragm, and when the pressure in said mouthpiece is reduced to a value lower than a predetermined pressure, the diaphragm is deformed to incline said valve plug, so that said valve plug is opened.

10. The semi-closed type of breathing apparatus as claimed in claim 9, wherein said valve plug is designed in a rod shape, and the tip portion thereof is engaged with one end portion of a lever which is connected to said diaphragm at the other end portion thereof, said lever serving to incline said valve plug in accordance with deformation of said diaphragm, so that said valve plug is opened.

11. A semi-closed type of breathing apparatus which removes carbon dioxide from breathing air, comprising:

a mouthpiece which is a breathing circuit adapted to be positioned in a user's mouth for exhalation and inhalation;

a canister filled with carbon dioxide remover to remove carbon dioxide from supplied air;

a breathing bag which is connected to said mouthpiece and said canister, and expands and contracts in accordance with flow in-and-out of breathing air, wherein said breathing bag is substantially triangular in shape, a sectional area at an upper side thereof adapted to extend laterally across a user's body from shoulder to shoulder, said sectional area at said upper side being larger than a sectional area at a lower side of said breathing bag, said lower side of said breathing bag adapted to be positioned nearer a user's waist, when a user carries said semi-closed type of breathing apparatus on his back;

a duct which connects said mouthpiece to said canister and said breathing bag; and an air tank for supplementing air in the breathing circuit.

12. A canister for use in the semi-closed type of breathing apparatus as claimed in claim 11, wherein said breathing bag is disposed so that the pressure center of the lungs of a user is coincident with the pressure center of said breathing bag when the user carries said semi-closed type of breathing apparatus on his back.

13. A canister for use in the semi-closed type of breathing apparatus as claimed in claim 11, wherein said breathing bag is formed of an elastic material in a bellows shape, and expands and contracts in accordance with flow in-and-out of the breathing air.

* * * * *